US011944162B1

(12) United States Patent
Wu

(10) Patent No.: US 11,944,162 B1
(45) Date of Patent: Apr. 2, 2024

(54) SHOELACE

(71) Applicant: JHIH HUEI TRADING CO., LTD., Changhua County (TW)

(72) Inventor: Yung-Yu Wu, Changhua County (TW)

(73) Assignee: JHIH HUEI TRADING CO., LTD., Changhua County (TW)

( * ) Notice: Subject to any disclaimer, the term of this patent is extended or adjusted under 35 U.S.C. 154(b) by 0 days.

(21) Appl. No.: 17/968,223

(22) Filed: Oct. 18, 2022

(51) Int. Cl.
*A43C 9/00* (2006.01)

(52) U.S. Cl.
CPC ..... *A43C 9/00* (2013.01)

(58) Field of Classification Search
CPC .... D04C 1/06; D04C 1/00; D04C 1/12; A43C 1/02; A43C 9/00; Y10T 24/37; Y10T 24/3787
See application file for complete search history.

(56) References Cited

U.S. PATENT DOCUMENTS 1,006,014 A * 10/1911 Sondley ..... D04C 1/00 87/2
5,272,796 A * 12/1993 Nichols ..... D04C 1/12 24/712
5,673,546 A * 10/1997 Abraham ..... A43C 9/00 87/3
6,283,004 B1 * 9/2001 Tseng ..... D07B 5/005 87/9
10,568,389 B1 * 2/2020 Lin ..... A43C 9/00
2003/0217445 A1 * 11/2003 Tseng ..... A43C 9/00 24/712
2009/0144953 A1 * 6/2009 Tsai ..... A43C 9/00 24/712
2012/0144631 A1 * 6/2012 Stanev ..... D04C 1/12 24/712
2013/0255045 A1 * 10/2013 Gonzalez ..... A43C 9/00 24/715.3
2017/0295887 A1 * 10/2017 Torres ..... A43C 9/00
2017/0340066 A1 * 11/2017 Ooki ..... D04C 1/06
2020/0232132 A1 * 7/2020 Fukuyama ..... B29C 61/025

FOREIGN PATENT DOCUMENTS

WO WO-9512994 A1 * 5/1995 ..... A43C 9/00

* cited by examiner

*Primary Examiner* — Robert Sandy
*Assistant Examiner* — Michael S Lee
(74) *Attorney, Agent, or Firm* — Muncy, Geissler, Olds & Lowe, P.C.

(57) ABSTRACT

A shoelace is provided, including: a core material and a woven layer. The core material defines an axial direction, and the woven layer is sleeved on the core material. The woven layer includes a plurality of strands, a plurality of ridge portions and a plurality of connecting portions. The plurality of ridge portions and the plurality of connecting portions are woven by the plurality of strands and arranged alternatively in a circumferential direction of the core material.

7 Claims, 4 Drawing Sheets

SHOELACE

BACKGROUND OF THE INVENTION

Field of the Invention

The present invention relates to a shoelace.

Description of the Prior Art

A conventional shoelace is woven by a plurality of strands, and an appearance of the shoelace can only be changed by changing the weaving method or color of the plurality of strands, which limits the variability of the shoelace and requires complicated processing steps. In addition, the conventional shoelace is generally formed as a flat rope or round rope with a smooth outer surface that provides insufficient friction force so that the shoelace is easy to loosen when tied.

The present invention is, therefore, arisen to obviate or at least mitigate the above-mentioned disadvantages.

SUMMARY OF THE INVENTION

The main object of the present invention is to provide a shoelace, which is not easy to loosen when tied and provides preferable appearance.

To achieve the above and other objects, the present invention provides a shoelace, including: a core material and a woven layer. The core material defines an axial direction, and the woven layer is sleeved on the core material. The woven layer includes a plurality of strands, a plurality of ridge portions and a plurality of connecting portions. The plurality of ridge portions and the plurality of connecting portions are woven by the plurality of strands and arranged alternatively in a circumferential direction of the core material.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
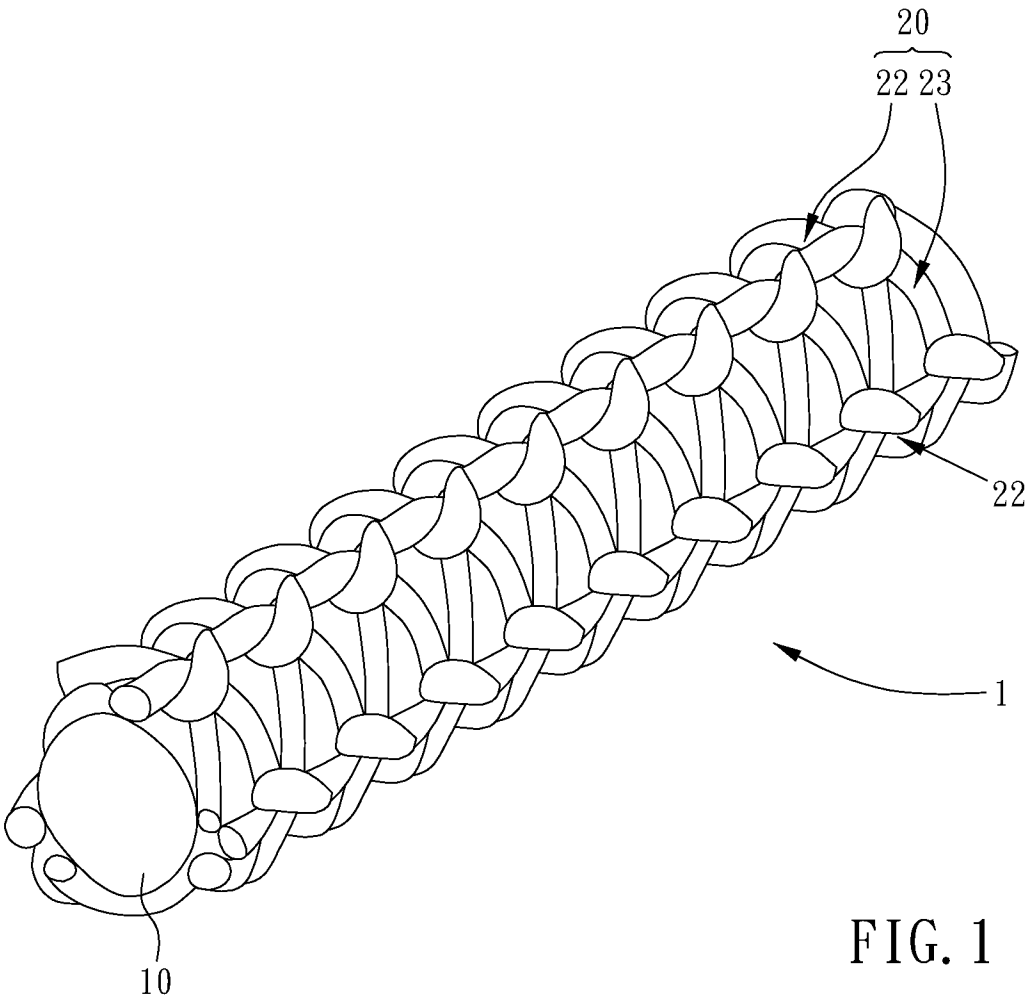
FIG. 1 is a stereogram of a preferable embodiment of the present invention.

Please refer to FIGS. 1 to 4 for a preferable embodiment of the present invention. A shoelace 1 of the present invention includes a core material 10 and a woven layer 20.

The core material 10 defines an axial direction, and the woven layer 20 is sleeved on the core material 10. The woven layer 20 includes a plurality of strands 21, a plurality of ridge portions 22 and a plurality of connecting portions 23, and the plurality of ridge portions 22 and the plurality of connecting portions 23 are woven by the plurality of strands 21 and arranged alternatively in a circumferential direction of the core material 10. Therefore, the woven layer 20 provides a relatively concave-convex outer surface to the shoelace 1 so that the shoelace 1 has special visual effect and sufficient friction force, and is not easy to loosen when tied.

Figure 2:
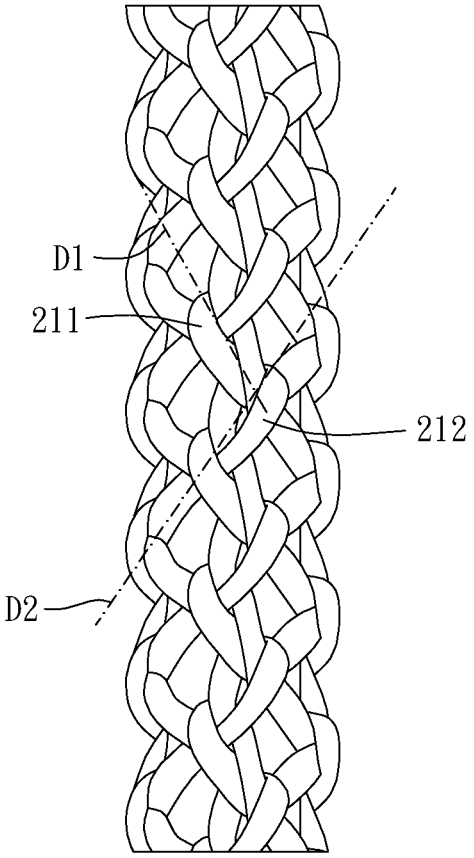
FIG. 2 is a side view of a preferable embodiment of the present invention.
Figure 3:
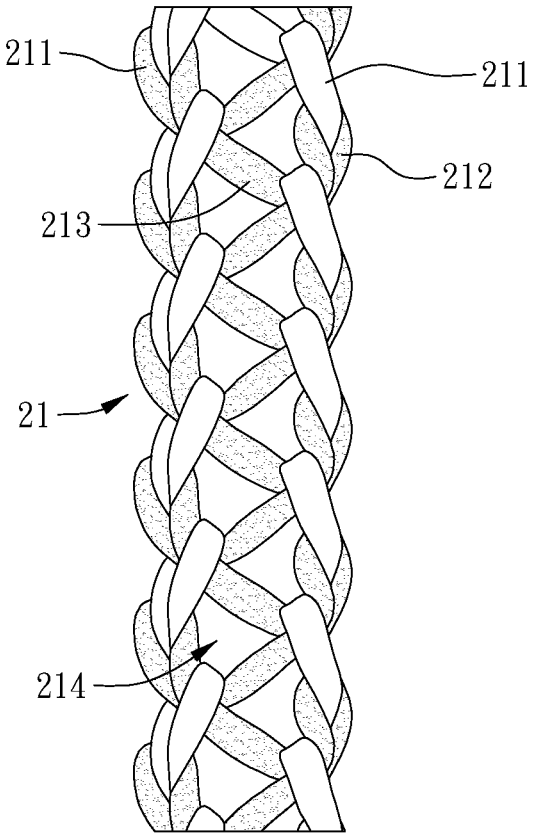
FIG. 3 is another side view of a preferable embodiment of the present invention.

Each of the plurality of strands 21 extends meanderingly along the axial direction and includes a plurality of first loops 211 and a plurality of second loops 212 which are arranged alternatively, and every adjacent one of the plurality of first loops 211 and one of the plurality of the second loops 212 have a connecting segment 213 connected therebetween, as one of said strands 21 marked with dots in FIG. 3. Said connecting segments 213 of each of the plurality of strands 21 define one of the plurality of connecting portions 23. The plurality of first loops 211 of one of the plurality of strands 21 are sleeved with the plurality of second loops 212 of another one of the plurality of strands 21 to form one of the plurality of ridge portions 22 so that the plurality of strands 21 are connected with one another and surround the core material 10. Each of the plurality of ridge portions 22 radially protrudes beyond each of the plurality of connecting portions 23 so that the shoelace 1 has a relatively concave-convex outer surface, which provides sufficient friction force when tied, and the shoelace 1 is not easy to loosen. In this embodiment, each of the plurality of first loops 211 extends in a first direction D1, and each of the plurality of second loops 212 extends in a second direction D2. The first direction D1 and the second direction D2 are non-parallel to each other and non-parallel to an extending direction of one of said connecting segments 213, as shown in FIG. 2. Therefore, each of the plurality of ridge portions 22 extends bendingly and regularly so as to have good appearance and good structural strength. In the axial direction, extending directions of every adjacent two of said connecting segments 213 are non-parallel; every adjacent two of said connecting segments 213 and one of the plurality of ridge portions 22 define a mesh 214 with a roughly triangular shape therebetween, and the core material 10 is exposed outwardly from said meshes 214 so as to provide special visual effect. A color of the core material 10 is preferably different from a color of the plurality of strands 21, and the plurality of strands 21 may include at least two different colors, which allows the shoelace 1 to have diverse visual effects.

Figure 4:
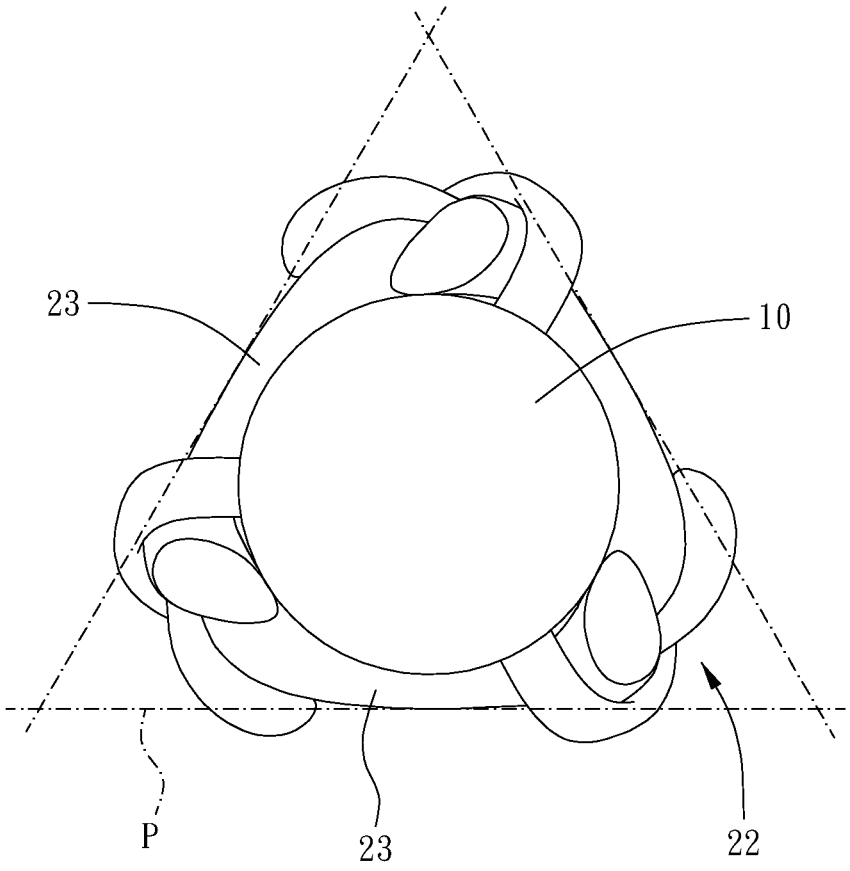
FIG. 4 is a front view of FIG. 1.

Refer to FIG. 4, as viewed in the axial direction, each of the plurality of connecting portions 23 at least partially extends along an imaginary plane P parallel to the axial direction, and said imaginary planes P define a polygon outline therebetween. The polygon outline may be triangular or rectangular, which provides special visual effect and sufficient friction force when the shoelace 1 is tied. In this embodiment, the plurality of ridge portions 22 are equiangularly arranged around the core material 10, and the polygon outline is an equilateral triangle; a number of the plurality of strands 21 is equal to a number of the plurality of ridge portions 22 so that the shoelace 1 has a simple appearance and a simple structure and is easy to manufacture.

Preferably, a stretch ratio of each of the plurality of strands 21 is smaller than a stretch ratio of the core material 10. At least a portion of the woven layer 20 is stretchable and slidable relative to the core material 10 in the axial direction so that the woven layer 20 can protect the core material 10 from abrasion and maintain a flexibility of the core material 10 at the same time. Before mounting a shoelace head, the woven layer 20 can be compressed or stretched in the axial direction, and said meshes 214 are deformed so as to change the touch, a stretch ratio and the visual effect of the shoelace 1. A wire diameter of each of the plurality of strands 21 is preferably smaller than a wire diameter of the core material 10, which can form said meshes 214 with a larger size and provides a preferable appearance and sufficient flexibility of the woven layer 20.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A shoelace, including:

a core material, defining an axial direction; and a woven layer, sleeved on the core material, including a plurality of strands, a plurality of ridge portions and a plurality of connecting portions, the plurality of ridge portions and the plurality of connecting portions being woven by the plurality of strands and arranged alternatively in a circumferential direction of the core material;

wherein each of the plurality of strands extends meanderingly along the axial direction and includes a plurality of first loops and a plurality of second loops which are arranged alternatively, and every adjacent one of the plurality of first loops and one of the plurality of second loops have a connecting segment connected therebetween;

wherein in the axial direction, extending directions of every adjacent two of said connecting segments are non-parallel;

wherein in the axial direction, every adjacent two of said connecting segments and one of the plurality of ridge portions define a mesh with a roughly triangular shape therebetween, and the core material is exposed outwardly from said meshes.

2. The shoelace of claim 1, wherein the plurality of first loops of one of the plurality of strands are sleeved with the plurality of second loops of another one of the plurality of strands to form one of the plurality of ridge portions.

3. The shoelace of claim 1, wherein a number of the plurality of strands is equal to a number of the plurality of ridge portions.

4. The shoelace of claim 1, wherein a stretch ratio of each of the plurality of strands is smaller than a stretch ratio of the core material.

5. The shoelace of claim 1, wherein as viewed in the axial direction, each of the plurality of connecting portions at least partially extends along an imaginary plane parallel to the axial direction, and said imaginary planes define a polygon outline therebetween.

6. The shoelace of claim 1, wherein the plurality of ridge portions are equiangularly arranged around the core material.

7. The shoelace of claim 1, wherein the plurality of first loops of one of the plurality of strands are sleeved with the plurality of second loops of another one of the plurality of strands to form one of the plurality of ridge portions; said connecting segments of one of the plurality of strands define one of the plurality of connecting portions; each of the plurality of first loops extends in a first direction, each of the plurality of second loops extends in a second direction, and the first direction and the second direction are non-parallel to each other and non-parallel to an extending direction of one of said connecting segments; a number of the plurality of strands is equal to a number of the plurality of ridge portions; as viewed in the axial direction, each of the plurality of connecting portions at least partially extends along an imaginary plane parallel to the axial direction, and said imaginary planes define a polygon outline therebetween; the polygon outline is triangular or rectangular; a stretch ratio of each of the plurality of strands is smaller than a stretch ratio of the core material; a wire diameter of each of the plurality of strands is smaller than a wire diameter of the core material; each of the plurality of ridge portions radially protrudes beyond each of the plurality of connecting portions; and at least a portion of the woven layer is stretchable and slidable relative to the core material in the axial direction.

* * * * *